US006619983B2

(12) United States Patent
Ota et al.

(10) Patent No.: US 6,619,983 B2
(45) Date of Patent: Sep. 16, 2003

(54) SOCKET FOR AUTOMOTIVE VEHICLES

(75) Inventors: Hidetoshi Ota, Tokyo (JP); Noboru Sato, Tokyo (JP); Takashi Sakamaki, Tokyo (JP)

(73) Assignee: Niles Parts Co., Ltd.

( * ) Notice: Subject to any disclaimer, the term of this patent is extended or adjusted under 35 U.S.C. 154(b) by 0 days.

(21) Appl. No.: 09/876,991

(22) Filed: Jun. 11, 2001

(65) Prior Publication Data

US 2001/0051460 A1 Dec. 13, 2001

(30) Foreign Application Priority Data

Jun. 12, 2000 (JP) ..... 2000-175585

(51) Int. Cl.[7] ..... H01R 13/73
(52) U.S. Cl. ..... 439/558; 439/722; 439/521
(58) Field of Search ..... 439/558, 557, 439/34, 35, 519, 521, 668, 736, 722, 562, 567

(56) References Cited

U.S. PATENT DOCUMENTS 3,818,282 A * 6/1974 Buxton et al. ..... 317/119
4,319,299 A * 3/1982 Woods et al. ..... 361/24
4,319,798 A * 3/1982 Mittelhauser ..... 439/172
4,410,226 A * 10/1983 Adduci et al. ..... 339/44
4,498,726 A * 2/1985 Mattis ..... 439/668
4,789,343 A * 12/1988 Dougherty et al. ..... 439/34
4,871,331 A * 10/1989 Kondo et al. ..... 439/736
5,116,233 A * 5/1992 Croce ..... 439/161
5,224,879 A * 7/1993 Mullins et al. ..... 439/651
5,455,753 A * 10/1995 Vollmann et al. ..... 362/226
5,486,991 A * 1/1996 Bodem, Jr. ..... 312/369
5,622,507 A * 4/1997 Kasai ..... 439/76.2
5,800,183 A * 9/1998 Paul et al. ..... 439/56
5,800,188 A * 9/1998 Barber et al. ..... 439/142
5,897,397 A * 4/1999 Yokozawa ..... 439/668
5,997,320 A * 12/1999 DeMello ..... 439/148

FOREIGN PATENT DOCUMENTS

JP UM 22552/1985 1/1985

* cited by examiner

*Primary Examiner*—P. Austin Bradley
*Assistant Examiner*—Edwin A. León
(74) *Attorney, Agent, or Firm*—Rader, Fishman & Grauer PLLC

(57) ABSTRACT

A socket for automotive vehicles is provided, in which the number of components and the assembling man-hour is small, and thus the cost is low. A vehicle socket is electrically connected to a power supply with a plug of an appliance for automotive vehicles. The socket is formed of a resinous molded body of near cylindrical shape comprising a flange along an outer periphery of an opening in which the plug is inserted, and terminals molded on the bottom surface by insert molding.

17 Claims, 5 Drawing Sheets

SOCKET FOR AUTOMOTIVE VEHICLES

BACKGROUND OF THE INVENTION

1. Field of the Invention

The present invention relates to a socket for automotive vehicles to be exclusively used for appliances having a plug for connecting to the cigarette lighter socket in the automotive vehicle.

2. Description of the Related Art

Hitherto, the socket for cigarette lighters is used for the provided appliances to be use in the automotive vehicle. However, a bimetal to which the heater cap of the plug of the cigarette lighter is fitted is projected from the insulator on the inner wall in such a socket. When a plug of the appliance for automotive vehicle other than the plug of the cigarette lighter is inserted into the socket for cigarette lighters, the plug resists engaging the bimetal described above, whereby the bimetal may disadvantageously be deformed or the plug of the appliance for automotive vehicles may be damaged.

As a socket devised to solve the problem described above, for example, there is a device disclosed in Japanese Utility Model Publication No.22552/1985. This socket is provided with a resinous mounting base on the side of the opening of the metal body, and with an insulating board having a terminal fitting and an insulating base having a terminal on the side of the bottom surface of the body. The body is formed of a conductive body almost in the shape of a can, and comprises a resilient strip to be brought into electrical contact with the plug and the bottom portion to be brought into electrical contact with the earth terminal to construct a part of an electric circuit. The bottom surface of the body is fixed with the terminal fitting, the insulating board, the insulating base, the earth terminal, and the plus terminal by caulking the terminal fitting.

However, since the socket described above is formed of a metal body comprising a resinous mounting base provided on the side of the opening and an insulating board having a terminal fitting and an insulating base having a terminal provided on the side of the bottom surface, the number of the components are large, and thus the number of steps to assemble, thereby increasing the cost.

The socket of the related art has only two holes; an opening and a notch formed by cutting three sides of the square in the vicinity of the opening; and the bottom surface of the socket has no hole thereon. Therefore, there are problems in that the heat releasing effect in case of abnormal heat generation in the plug is small, and in that when the water entered therein, it cannot be discharged easily. In addition, when the body is heated, the heat is easily transmitted to the whole part of the metallic body, and thus the collar of the body outside of the flange may cause burn injury when the body gets into touch with it.

Since the size of the socket and the plug for cigarette lighters varies conventionally, there is recognized problem in that the plug may fall off the socket due to the vibration of the vehicle body when the size of the plug does not conform to the size of the socket.

SUMMARY OF THE INVENTION

Accordingly, the object of the present invention is to provide a socket for automotive vehicles in which the number of the parts and the number of steps for assembly are small and the cost is low.

The present invention is directed to solve the problems of the related art described thus far, and the invention according to a first aspect is a socket for automotive vehicles for receiving the plug of the appliance for automotive vehicles to electrically connect to the power supply, comprising a near cylindrical resinous molded body having a flange formed along the outer periphery of the opening to which the plug is inserted, and terminals formed on the bottom surface by insert molding.

The invention according to a second aspect is an invention according to the first aspect, wherein the socket is provided with a conductive inner case to be brought into contact with resilient electrodes of the plug on the inner wall surface of the socket, and a bimetal to be brought into contact with the terminal in conduction with the inner case in case of abnormal heat generation is electrically connected to the terminal disposed on the bottom surface thereof.

The invention according to a third aspect is an invention according to the second aspect, wherein the inner case comprises a cylindrical portion formed on the inner wall surface of the socket, the terminal projected from the cylindrical portion, and the earth terminal all formed of a piece of conductive metal plate.

The invention according to a fourth aspect is an invention according to the third aspect, wherein the terminal and the earth terminal are formed by tucking down from the inner wall surface of the socket to form recesses for disposing the resin material forming the socket.

The invention according to a fifth aspect is an invention according to the second, third or fourth aspect, wherein the terminal comprises a power supply connecting portion projecting outwardly from the bottom surface of the socket for being connected with the power supply, and a connecting projection being in contact with the electrode portion of the plug and exposed from the center of the bottom surface, and wherein the bimetal is electrically connected to the terminal at the portion surrounding the connecting projection.

The invention according to a sixth aspect is an invention according to the fifth aspect, wherein the terminal includes a supporting strip for positioning thereof projecting outwardly from the portion surrounding the connecting projection to be supported by the metal mold when the socket is molded by the metal mold.

The invention according to a seventh aspect is an invention according to the sixth aspect, wherein the bottom surface of the socket is formed of insertion holes adjacent to the supporting strips or the connecting projection.

The invention according to an eighth aspect is an invention according to the fifth aspect, wherein the bimetal is formed into the shape of near L-shape and formed with a through hole for fitting the shoulder formed around the connecting projection therein on one end and provided with a temperature deformation portion inserted into the hollow portion formed on the bottom surface of the socket so as to be opposed to the terminal in conduction with the inner case on the other side.

The invention according to a ninth aspect is an invention according to the first, second, third, fourth, fifth, sixth, seventh or eighth aspect, wherein the socket includes a projection formed of an insulating resin on the bottom surface.

The invention according to a tenth aspect is an invention according to the first or second aspect, wherein the socket is formed with a resilient arresting strips on the outer periphery thereof to which the inner edge of the mounting hole on the vehicle-side member abuts, and a threaded portion with which the nut for screwing the socket to the mounting hole on the vehicle-side member engages.

The invention according to an eleventh aspect is an invention according to the first, second, third, fourth or tenth aspect, wherein the socket is formed in the opening with a plug holding portion to which the resilient supporting portions provided on the outer periphery of the plug engages.

The invention according to a twelfth aspect is an invention according to the eleventh aspect, wherein the socket is provided with a mark on the flange for registering the resilient supporting portion of the plug and the plug holding portion.

DESCRIPTION OF THE PREFERRED EMBODIMENTS

Figure 1:
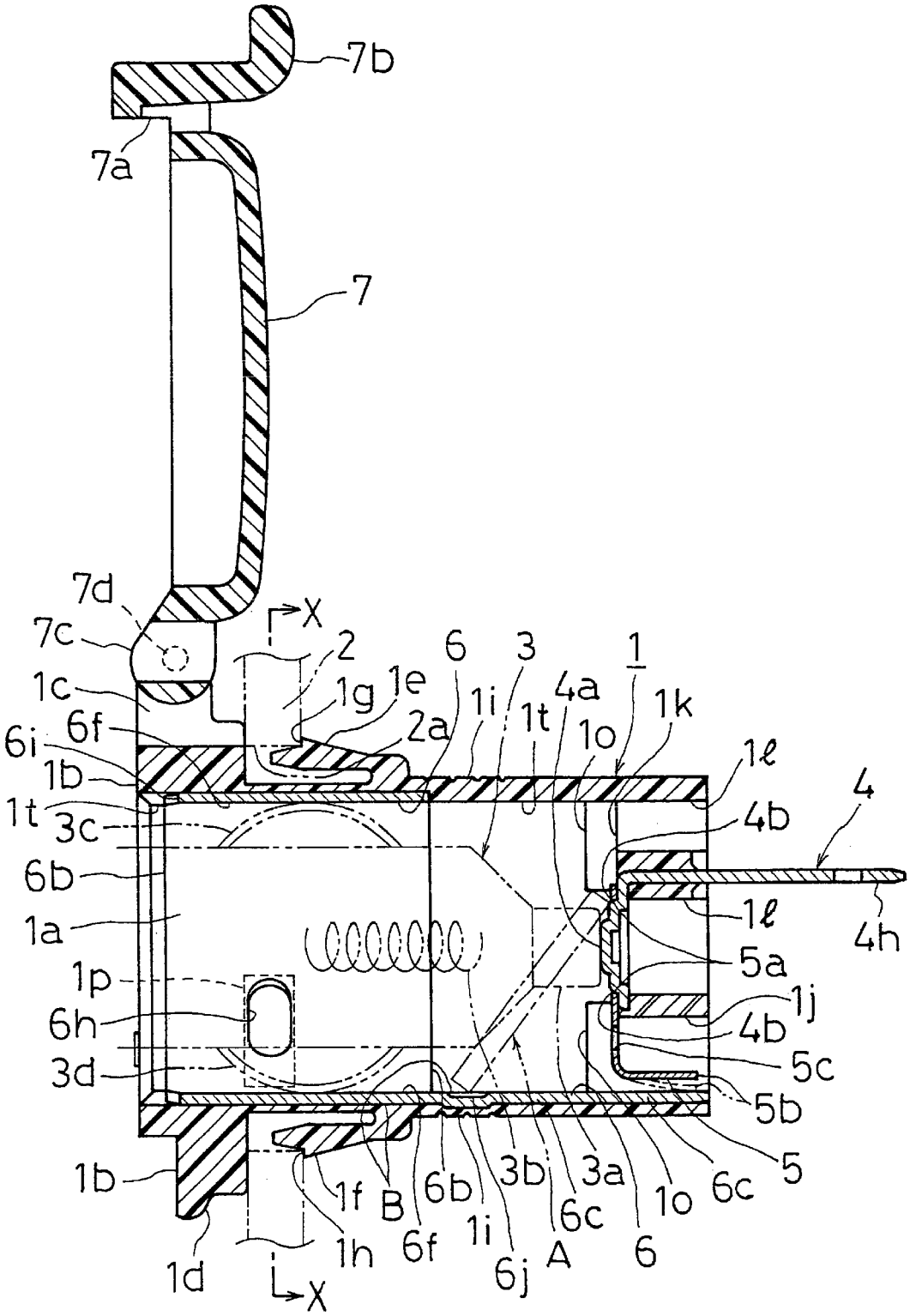
FIG. 1 is a longitudinal central cross-section of an embodiment of the present invention showing a state in which a lid is opened.

Referring now to FIG. 1 to FIG. 9, an embodiment of the present invention will be described.

Reference numeral 1 designates a resinous socket for appliances to be used in the automotive vehicle, which is almost the cylindrical shape. The socket 1 is inserted into the mounting hole 2*a* on the vehicle-side member 2, for example, the sidewall or the like in the interior of the cabin such as the instrument panel, the console box, the door, or the luggage room or the like.

The socket 1 is formed of a heat-resistance insulating resin such as nylon containing for example glass component by approximately 30[%]. The socket 1 is an electrically connecting equipment formed in the shape of the cylinder with a bottom, and installed in the opening 1*a* so as to be freely closed by a lid 7. On the outer periphery of the opening 1*a*, there is formed a flange 1*b*. The flange 1*b* is formed with a hinge portion 1*c* for holding the lid 7 so as to rotate freely, a locking portion 1*d* provided at the position opposing to the hinge portion 1*c*.

In the vicinity of the flange 1*b*, as shown in FIG. 1, resilient arresting strips 1*e*, 1*f* to which the mounting hole 2*a* of the vehicle-side member 2 is press-fitted are formed, and the shoulders 1*g*, 1*h* on the resilient arresting strips 1*e*, 1*f* and the inner surface of the flange 1*b* fix the socket 1 to the vehicle-side member 2 through one-touch operation. In the case where it is installed to the mounting hole 2*a* formed on the relatively thin member such as an instrument panel or a console box, as shown in FIG. 1, the resilient arresting strips 1*e*, 1*f* is used to install it to the vehicle-side member 2.

Figure 3:
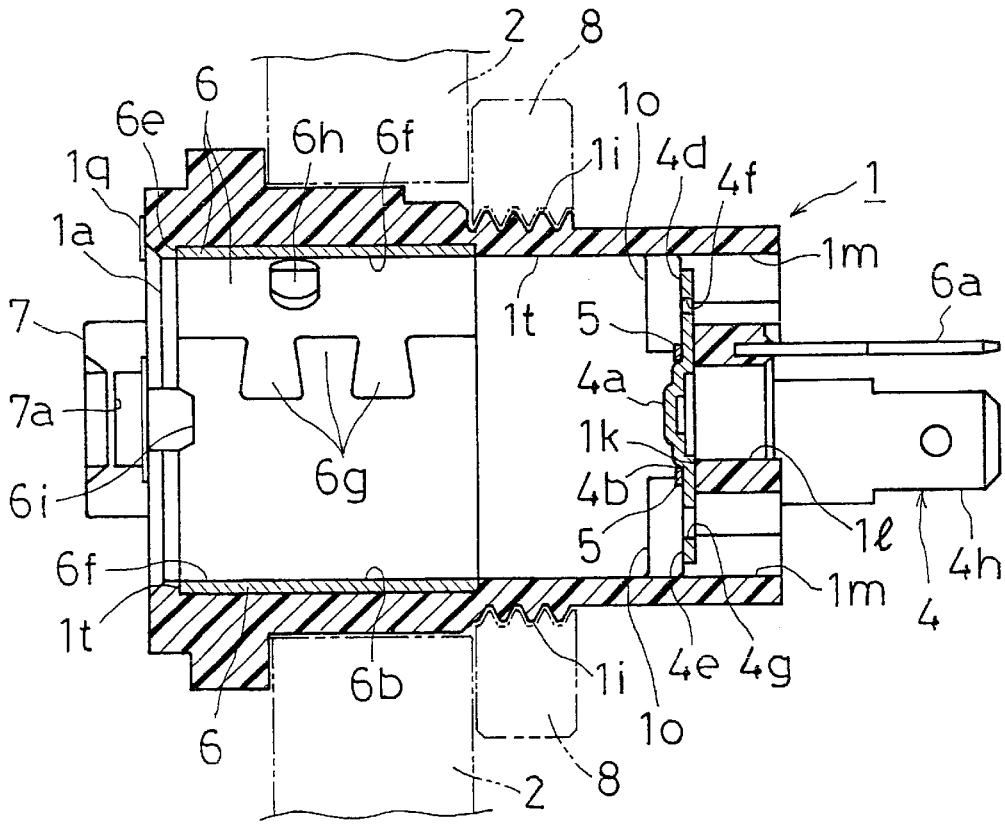
FIG. 3 is a lateral central cross-section of an embodiment of the present invention showing a state in which the lid is opened.
Figure 4:
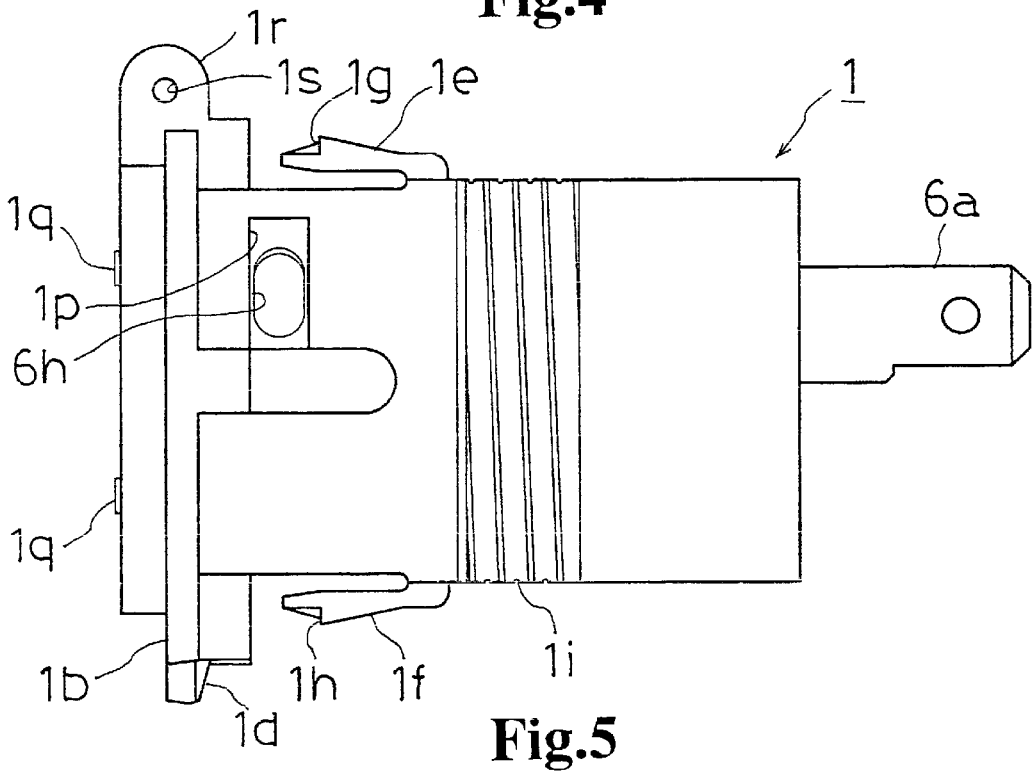
FIG. 4 is a front view of an embodiment of the present invention showing a state in which the lid is removed.

In the case where the socket 1 is mounted to the luggage room of which the thickness of the vehicle-side member 2 is thick member, as shown in FIG. 3, it is screwed by engaging a nut 8 to the threaded portion 1*i* formed on the outer periphery of the socket 1.

Figure 2:
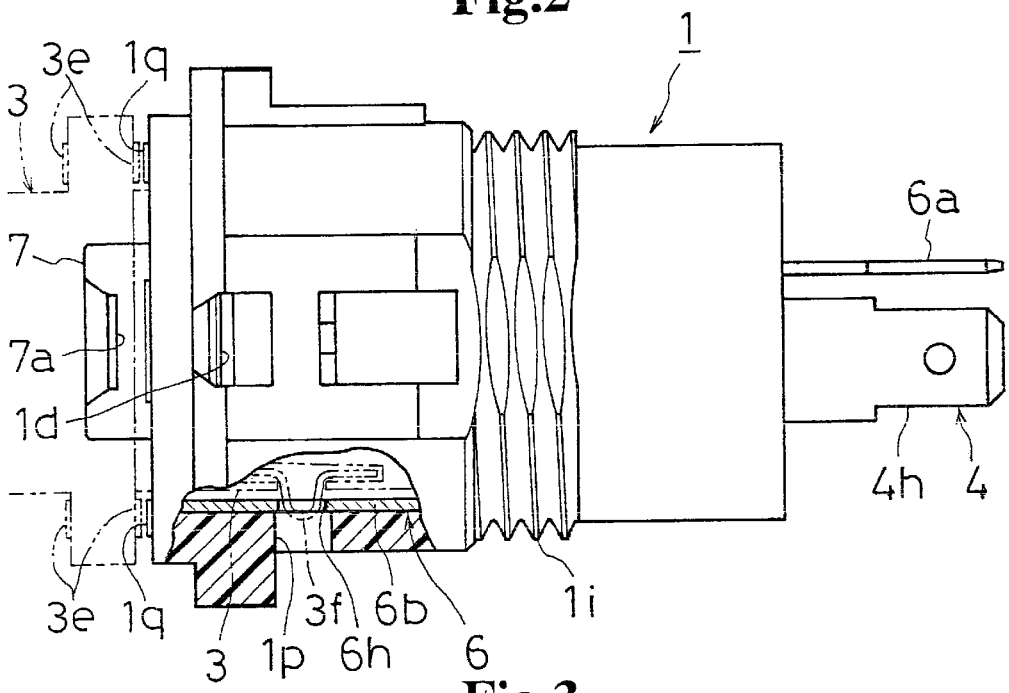
FIG. 2 is a bottom view of an embodiment of the present invention showing a state in which the lid is opened.
Figure 6:
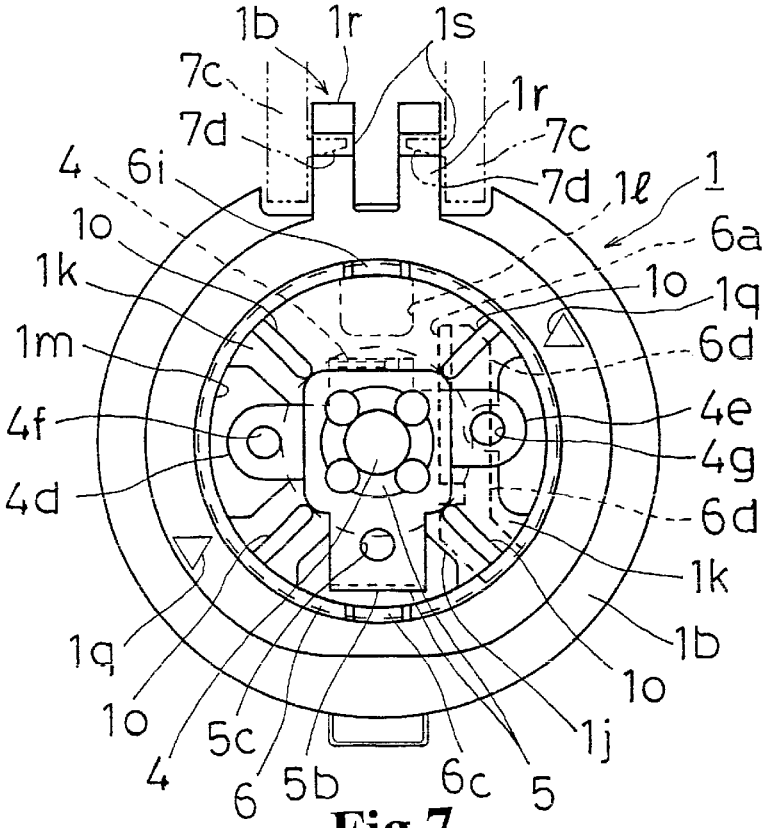
FIG. 6 is a front view of the embodiment of the present invention showing a state in which the lid is removed.

On the front side of the flange 1*b*, as shown in FIG. 6, there is a triangle mark 1*q* representing the position where the plug holding portion 6*h* formed in the socket 1 resides. The mark 1*q* is, as shown in FIG. 2, a remarque to represent the position that the resilient supporting portion 3*f* that is provided on the plug 3 is fitted to the plug holding portion 6*h* when the plug 3 is inserted into the socket 1 with the mark 3*e* provided on the plug 3 registered therewith.

When the plug 3 is inserted into the socket 1 with the mark 3*e* of the plug 3 registered with the mark 1*q*, the resilient supporting portion 3*f* is fitted to the plug holding portion 6*h*, thereby preventing the plug 3 is from being fallen off the socket 1.

The flange 1*b* is formed with a hinge portion 1*c* for rotatably mounting the lid 7 to close the opening 1*a*, for example, on the upper side. The lid 7 mounted on the hinge portion 1*c* can be maintained in a state of closing the opening 1*a* with the claw 7*a* hooked to the locking portion 1*d* by holding the grip portion 7*b* with a hand and pressing the claw 7*a* toward the locking portion 1*d*.

The hinge portion 1*c* is formed by engaging the shaft portions 7*d*, 7*d*, formed on the projecting strips 7*c*, 7*c* into the shaft holding holes 1*s* formed on the tongue strips 1*r* shown in FIG. 6. Since the lid 7 is formed entirely of resin, and the projecting strips 7*c*, 7*c* have resiliency, it can be mounted to the hinge portion 1*c* of the socket 1 through one-touch operation by press fitting the projecting strips 7*c*, 7*c* to the outsides of the tongue strips 1*r*, 1*r*.

The plug holding portion 6*h* is constructed of a continued hole formed on the inserting space 1*p* of the socket 1 and the cylinder portion 6*b* of the inner case 6. The resilient supporting portion 3*f* of the plug 3 is, as shown by a phantom line in FIG. 2, constructed of a resilient projection formed on the outer wall of the plug 3 to be inserted into the socket 1. The resilient supporting portion 3*f* is a member that is formed by incurvating the leaf spring to be fitted to the plug holding portion 6*h* so as to projects from the plug 3 for rising and setting movement, and constructed of projections such as the resilient electrode strips 3*c*, 3*d* described above.

Figure 9:
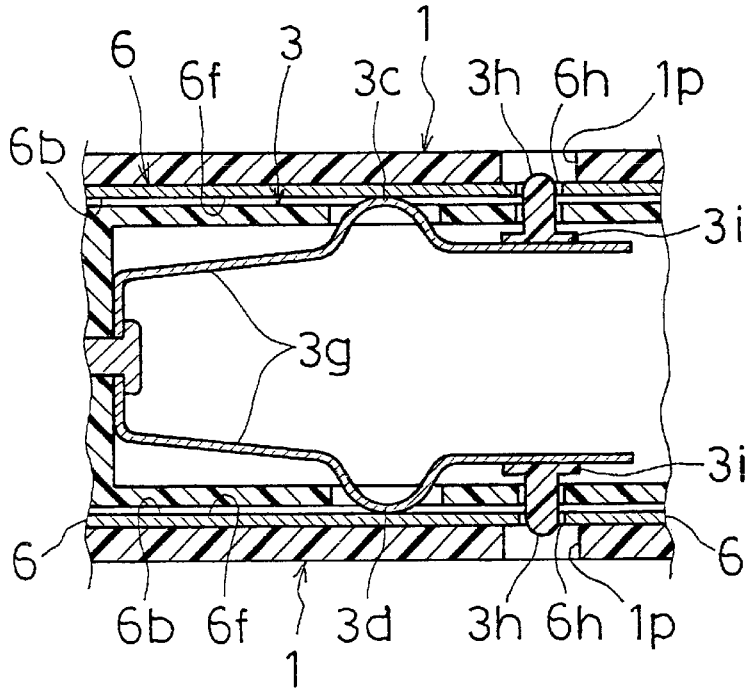
FIG. 9 is across-sectional view showing a principal portion of another embodiment of the present invention.

The resilient supporting portion 3*f* may be a resilient supporting portion 3*h* formed of a projection such as a pin that is urged by a spring member 3*g* constituting the resilient electrode portions 3*c*, 3*d* and fitted to the plug holding portion 6*h* as shown in FIG. 9, and the configuration is not specifically limited. The resilient supporting portion 3*h* is formed with a flange 3*i* at the proximal end to be urged by the spring member 3*g*, and the tip portion thereof is formed in a semi-spherical shape so that it can easily be fitted to and released from the plug holding portion 6*h*.

While the plug holding portion 6*h* to which the resilient supporting portions 3*f*, 3*h* are fitted is described to be formed on the cylindrical portion 6*b* of the inner case 6 as shown in FIG. 1, FIG. 3, and FIG. 9, it can also be disposed so as to be fitted directly to the insertion space 1*p* of the socket 1. The resilient supporting portion 3*f* may also be used as the resilient electrodes 3*c*, 3*d*.

The socket 1 comprises a power supply terminal 4 at the bottom surface 1*k*, a bimetal 5 electrically conducted to the power supply terminal 4, and an earth terminal 6*a* of the inner case 6 formed by insert molding. The bottom surface 1*k* is formed with a insertion holes 11, 1*m*, 1*n* for inserting the pins for supporting the respective members when the power supply terminal 4, the bimetal 5, and the earth terminal 6*a* are molded with the metal mold.

The insertion hole 11 is a hole formed by inserting the metal mold pin (not shown) for supporting the power supply terminal 4 and the bimetal 5 at the time of molding, and has an effect to discharge heat from the plug 3 fitted in the socket 1. The insertion holes 1*m*, 1*n* are, as shown in FIG. 3, are holes formed by inserting the metal mold pins supporting the supporting strips 4*d*, 4*e* projected outwardly from the center of the power supply terminal 4 along the bottom surface 1*k* as shown in FIG. 3 at the time of molding, and has an effect to discharge heat of the plug 3 fitted to the socket 1.

The supporting strips 4*d*, 4*e* are formed with positioning holes 4*f*, 4*g* for receiving the tips of the metal mold pins to hold at the predetermined position. Since the power supply terminal 4 and bimetal 5 are supported by fitting a plurality of metal mold pins into the positioning holes 4*f*, 4*g*, 5*c* at the time of molding, it can be molded while being disposed at the precise position by insert molding.

The bottom surface 1*k* is, as shown in FIGS. 1, 3, 6, and 7, formed with a plurality of projections 1*o* projecting outwardly of the opening 1*a* for preventing short circuit. The projection 1*o* is a projection for preventing short circuit in case where an infant or the like inserts the conductive member such as a coin into the socket 1, and the conductive member is brought into contact with the power supply terminal 4.

As shown in FIG. 1, the power supply terminal 4 projects from the back surface of the socket 1 to be electrically connected to the battery via the mating connector (not shown) at one end, and is provided with a connecting projection 4*a* exposed inwardly at the center of the bottom portion 1*k* of the socket 1 at the other end, so that the connecting projection 4*a* is brought into contact with the electrode 3*a* urged by the spring 3*b* to establish electric connection. The connecting projection 4*a* is a projection having a shoulder 4*b*, and the connecting projection 4*a* is fitted into the through hole 5*a* of the bimetal 5, and the peripheral region of the through hole 5*a* is welded to the shoulder 4*b* by resistance welding or the like.

The fixing means between the power supply terminal 4 and the bimetal 5 is not specifically limited as far as they are always connected electrically. For example, the bimetal 5 may be fixed to the power supply terminal 4 by caulking.

The bimetal 5 is formed of a plate member in the shape of near L-shape as show in FIG. 1, the fixed side of which at one end is fixed to the shoulder potion 4*b* by means of measures such as caulking or the like and the temperature deformation side 5*b* at the other end is disposed in the hollow portion 1*j* of the bottom surface 1*k* of the socket 1. At normal temperature, the temperature deformation portion 5*b* is not in contact with the inner case 6 provided on the inner side of the socket 1 as shown by a solid line in FIG. 1, and when it is heated to a high temperature by abnormal heat generation or the like, it incurvates as shown by a phantom line in FIG. 1 to come into contact with the inner case 6. The bimetal 5 is a safety apparatus that constructs the short circuit mechanism that short-circuits when it comes into contact with the inner case 6, and prevents the car blaze or the like by melting the fuse mounted on the side of the harness (not shown) of the vehicle body.

In the hollow portion 1*j* described above, a temperature deformation portion 5*b* of the bimetal 5 is disposed so as to be capable of incurvated deformation as shown in FIG. 1, and when the bimetal 5 is molded in the socket 1 by insert molding, the pin (not shown) is inserted into the hollow portion 1*j* to the extent that the tip of the pin is fitted into the positioning hole 5*c* for molding. The positioning hole 5*c* is disposed at the end of the opening of the hollow portion 1*j*.

The inner case 6 comprises, as shown in FIG. 1, FIG. 3, FIG. 6, and FIG. 8, a cylindrical portion 6*b* to be brought into contact with a resilient electrode strips 3*c*, 3*d*, a terminal 6*c* extending from the cylindrical portion 6*b*, an earth terminal 6*a*, and a distribution board portion 6*d* formed between the earth terminal 6*a* and the cylindrical portion 6*b* formed as a single piece.

The inner case 6 is formed by press-molding the conductive metal plate formed of copper alloy or the like, and fixed to the socket 1 by insert molding. The end portion 6*e* of the inner case 6 on the side of the opening 1*a* is formed at the position inner than the opening 1*a* to prevent physical contact therewith as shown in FIG. 3. The inner wall surface 6*f* of the cylindrical portion 6*b* of the inner case 6 is flush with the inner wall surface 1*t* of the socket 1 as shown in FIG. 1 and FIG. 3.

Figure 8:
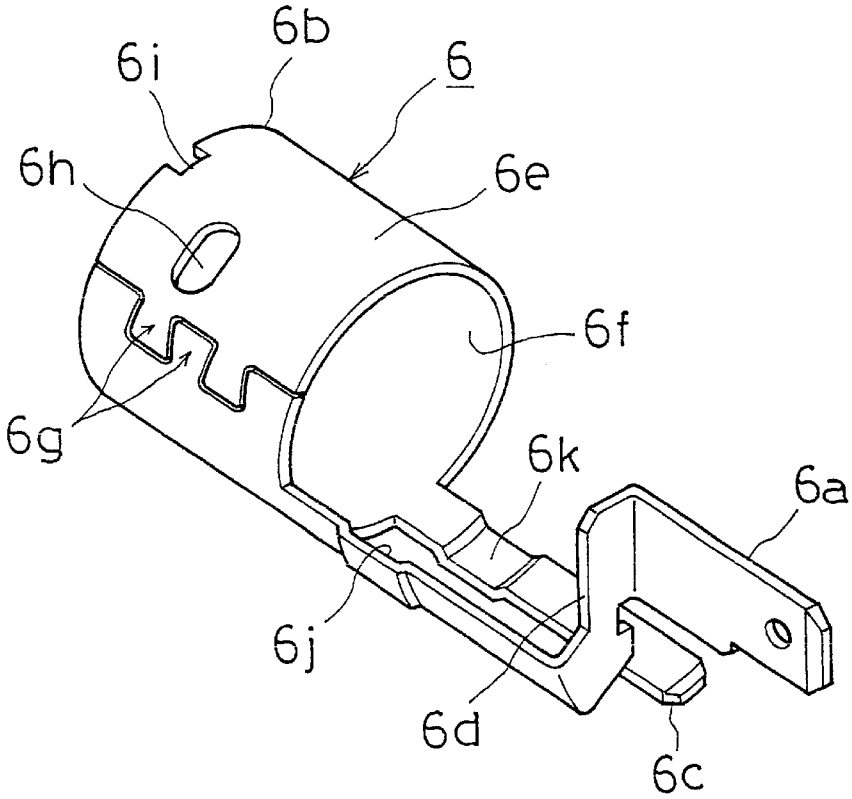
FIG. 8 is a perspective view of the inner case showing an embodiment of the present invention.

The cylindrical portion 6*b* is a portion that is disposed inside near the opening 1*a* for coming into contact with the resilient electrodes 3*c*, 3*d* of the plug 3 for grounding as shown in FIG. 1 and FIG. 3. The cylindrical portion 6*b* is, as shown in FIG. 8, formed by engaging the trapezoidal engaging portions 6*g* formed along both edges of a near square plate with respect to each other into a cylindrical shape. The cylindrical portion 6*b* is, as shown in FIG. 2, formed with a plug holding portion 6*h*, which is a hole formed at the same position as the inserting space 1*p* of the socket 1. At the end of the opening of the cylindrical portion 6*b*, as shown in FIG. 8, there is formed a notched portion 6*i* for holding the inner case 6 to be inserted therein by engaging the metal mold pin when the socket 1 is molded with a resin.

From the cylindrical portion 6*b*, the earth terminal 6*a* and the terminal 6*c* are formed as a single unit so as to project therefrom. The earth terminal 6*a* and the terminal 6*c* are formed with bent recesses 6*j*, 6*k* for preventing short-circuit by burying the earth terminal 6*a* and the terminal 6*c* with an insulating resin material B forming the socket 1 so that the coin A does not come into contact with the power supply terminal 4 and the inner case 6 simultaneously when a conductive body such as a coin A or the like is inserted into the socket 1 by mistake as shown in FIG. 1.

The recesses 6*j*, 6*k* are formed at the positions in such a manner that when the end of the coin A or the like inserted into the socket 1 comes into contact with the power supply terminal 4, the other end of the coin A or the like comes into contact with the inner wall surface 1*t*, and a resinous material B forming the socket 1 is poured into the recesses 6*j*, 6*k* to prevent it from being exposed. This can prevent short-circuit because the coin A is never be brought into contact with the power supply terminal 4 and the inner case 6 simultaneously to constitute a part of the electrical circuit.

The position to form the recesses 6*j*, 6*k* on the inner case 6 is not limited to the position shown in FIG. 1 and FIG. 8, but it must simply be between the cylindrical portion 6*b* and the earth terminal 6*a*, or the portion between the cylindrical portion 6*b* and the earth terminal 6*a* may be buried within the socket 1 with a resinous material.

The terminal 6*c* is formed of a plate extending from the cylindrical portion 6*b* along the inner wall surface 1*t* of the socket 1 to the back surface of the bottom surface 1*k*. In case of abnormal heat generation, the bimetal 5 is deformed and comes in contact with the terminal 6*c*. The terminal 6*c* may be formed integrally with the earth terminal 6*a* projected from the cylindrical portion 6*b*, and the earth terminal 6*a* may be constructed to serve also as the terminal 6*c* by allowing the bimetal 5 to come into contact with a part of the earth terminal 6*a*.

Figure 5:
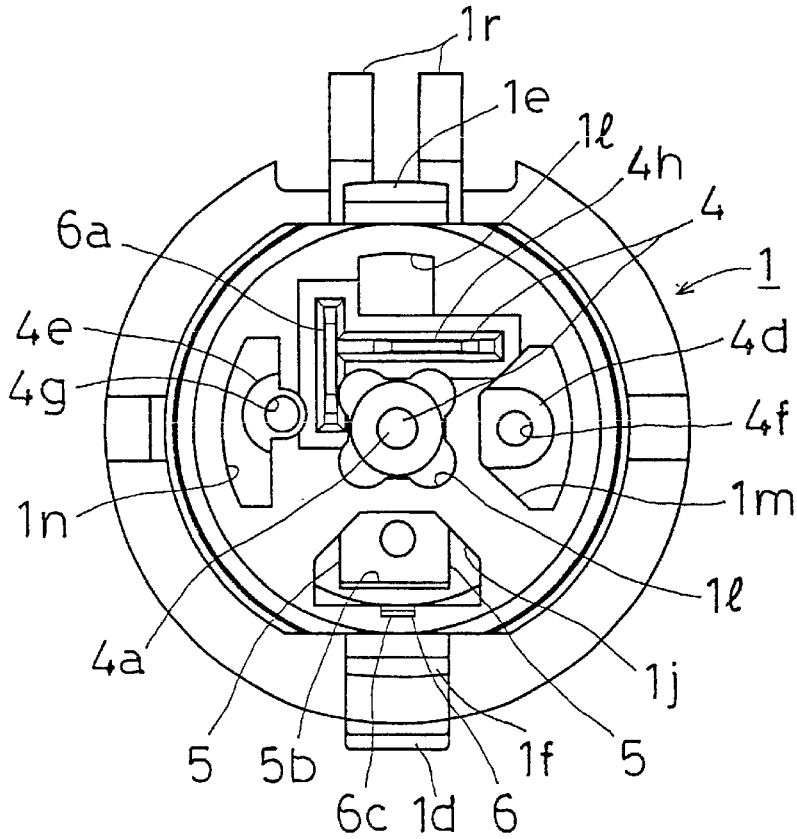
FIG. 5 is a back view of the embodiment of the present invention showing a state in which the lid is removed.
Figure 7:
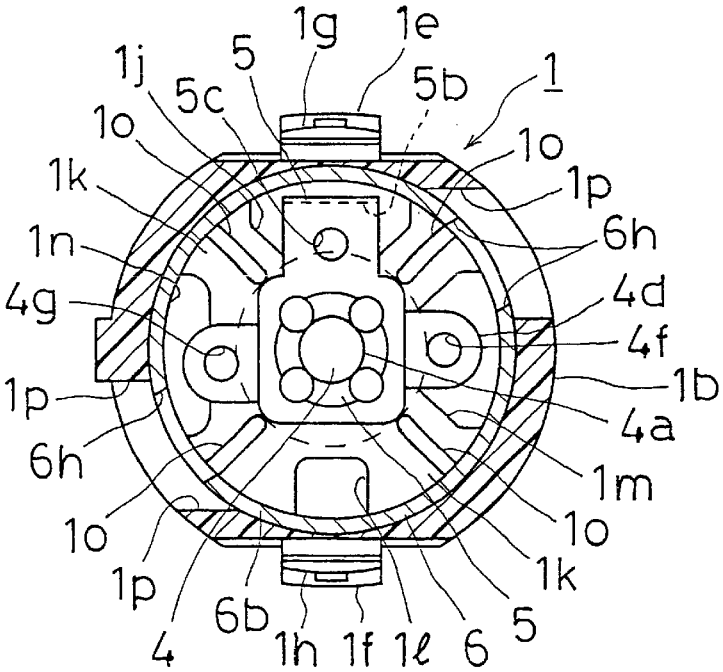
FIG. 7 is a cross sectional view taken along the line X—X of FIG. 1.

The earth terminal 6*a* is a terminal that projects from the portion in the vicinity of the power supply terminal 4 on the back surface of the bottom of the socket 1 to be fitted to the mating connector. The distribution board 6*d* is a member that is formed between the earth terminal 6*a* and the recess 6*j* to connect them with each other, and is buried in the bottom surface 1*k* of the socket 1 as shown by a phantom line in FIG. 6. The bottom surface 1*k* is, as shown in FIG. 5, FIG. 6, and FIG. 7, formed with a hollow portion 1*j* and insertion holes 1*l*, 1*m*, 1*n*, in the shape like four beams. The distribution board 6*d* may simply be inserted into any one of four beams and molded by insertion molding.

The plug 3 to be fitted into the opening 1*a* of the socket 1 is a electrically connecting equipment for connecting various charger for mobile telephones, or the electrical appliances such as the TV set or the navigator apparatus and the like to be retrofitted with the socket of the cigarette lighter.

The present invention is constructed as described thus far, and the manufacturing procedure and the operation will be described in detail below.

In a first place, the electrode terminal 4, the bimetal 5, and the metallic member for the inner case are press-molded. The electrode terminal 4 and the bimetal 5 are fixed by welding or caulking. Then, the respective metal mold pins are fitted into the positioning holes 4*f*, 4*g* of the power supply terminal 4 and the positioning hole 5*c* for the bimetal 5 to set the metal mold, and a resinous material is poured into the metal mold to mold the socket 1 with a metal mold. In this way, the socket 1 needs only the small number of components, processes, and assembling man-hour, and thus is low in cost and suitable for mass production.

The projecting strip 7*c* of the lid 7 is pushed into the hinge portion 1*c* of the socket 1 to mount the lid 7 to the socket 1.

By pushing the socket 1 into the mounting hole 2*a* of the vehicle-side member 2, the resilient arresting strips 1*e*, 1*f* is press-fitted into the inner edge of the installing hole 2*a* as shown in FIG. 1 so that the socket 1 can be mounted to the vehicle body member 2 through one-touch operation. By fitting the mating connector to the power supply terminal 4 and the earth terminal 6*a*, the assembly to the vehicle body member 2 is completed.

When the thickness of the vehicle-side member 2 to which the socket 1 is mounted is large, the socket 1 can be mounted to the vehicle-side member 2 by engaging the nut 8 with the threaded portion 1*i* as shown in FIG. 3. Therefore, it can be mounted at various portion of the vehicle-side member 2.

Since the present invention is constructed and operated as describe so far, the following advantages are achieved.

Since the invention according to the first aspect is a socket for automotive vehicles for receiving the plug of the appliance for automotive vehicles to electrically connect to the power supply, comprising a near cylindrical resinous molded body having a flange formed along the outer periphery of the opening to which the plug is inserted, and a terminal formed on the bottom surface by insert molding, the entire socket can be formed with a resin at a time, and thus the number of components and of the step of assembling operation can be reduced to reduce the cost. In addition, since the bottom surface of the socket does not need the rivet for fixing the terminal that has been conventionally used, or the insulator for insulation, the construction of the socket may be simplified.

Since the invention according to the second aspect is an invention according to the first aspect, wherein a conductive inner case to be brought into contact with a resilient electrode of the plug is provided on the inner wall surface of the socket, and a bimetal to be brought into contact with the terminal in conduction with the inner case in case of abnormal heat generation is electrically connected to the terminal disposed on the bottom surface thereof, occurrence of the accident such as fire due to abnormal heat generation can be prevented with a simplified construction without increasing the number of the components.

Since the invention according to the third aspect is an invention according to the second aspect, wherein the inner case comprises a cylindrical portion formed on the inner wall surface of the socket, the terminal projected from the cylindrical portion, and the earth terminal all formed of a piece of conductive metal plate, the cylindrical portion, the terminal, and the earth terminal can be formed with a member, and thus the number of components and of assembling man-hour can be reduced to reduce the cost.

Since the invention according to the fourth aspect is an invention according to the third aspect, wherein the terminal and the earth terminal are formed by tucking down from the inner surface of the socket to form a recess for disposing the resin material forming the socket, the short-circuit that may be occurred when a conductive body such as a coin is inserted into a socket by mistake may be prevented, and electric shock that may occur in the case of removing the coin may be prevented.

Since the invention according to the fifth aspect is an invention according to the second, third or fourth aspect, wherein the terminal comprises a power supply connecting portion projecting outwardly from the bottom surface of the socket and a connecting projection being in contact with the electrode portion of the plug and exposed from the center of the bottom surface, and wherein the bimetal is electrically connected to the terminal at the portion surrounding the connecting projection, the bimetal can be fixed to the terminal formed by combining the power supply connecting portion and the connecting projection as an unit without using a special fitting such as a rivet or the like, and thus the number of components and of assembling man-hour as well as the cost can be reduced.

Since the invention according to the sixth aspect is an invention according to the fifth aspect, wherein the terminal includes a supporting strip for positioning thereof projecting outwardly from the portion surrounding the connecting projection to be supported by the metal mold when the socket is molded by the metal mold, the socket can be formed while holding the terminal precisely and stably at the prescribed position without shaking when molding the terminal integrally with the socket, and thus the operation for molding the socket with the metal mold can easily be performed. Therefore, the terminal molded in the socket by insert molding and the bimetal can be disposed precisely and loose connection of the terminal and inferior operation of the bimetal can be prevented.

Since the invention according to the seventh aspect is an invention according to the sixth aspect, wherein the bottom surface of the socket is formed of a insertion hole adjacent to the supporting strip or the connecting projection, the terminal can be supported and thus the socket can be formed in precise dimensions and configuration by inserting the metal mold pin into the insertion hole when the socket is molded with the metal mold. In addition, since the bottom surface of the socket is formed with an insertion hole, the heat discharging effect that can discharge heat from the insertion hole can be achieved.

Since the invention according to the eighth aspect is an invention according to the fifth aspect, wherein the bimetal is formed into the shape of near L-shape and formed with a through hole for fitting the shoulder formed around the connecting projection therein on one end and provided with a temperature deformation portion inserted into the hollow portion formed on the bottom surface of the socket so as to be opposed to the terminal in conduction with the inner case on the other side, the bimetal can easily be installed around the connecting projection. By forming a hollow portion in the bottom surface, the heat discharge effect that can discharge heat from the hollow portion can be achieved, and water entered into the socket can discharged from the socket through the hollow portion, thereby providing waterproof function.

Since the invention according to the ninth aspect is an invention according to the first, second, third, fourth, fifth, sixth, seventh or eighth aspect, wherein the socket includes a projection formed of an insulating resin on the bottom surface, when an infant or the like inserted a conductive member such as a coin into the socket by mistake, the conductive member such as a coin comes into contact with the terminal to prevent short-circuit.

Since the invention according to the tenth aspect is an invention according to the first or second aspect, wherein the socket is formed with a resilient arresting strip on the outer periphery thereof to which the inner edge of the mounting hole on the vehicle-side member, and a threaded portion with which the nut for screwing the socket to the mounting hole on the vehicle-side member engages, the socket can be mounted to the mounting hole of different thickness of the vehicle body member, and thus the socket can conveniently be mounted at the position other than the limited prescribed position of the vehicle body member.

Since the invention according to the eleventh aspect is an invention according to the first, second, third, fourth or tenth aspect, wherein the socket is formed in the opening with a plug holding portion to which the resilient supporting portion provided on the outer periphery of the plug engages, the plug inserted into the socket is prevented from being fell off the socket due to vibration of vehicle-side member and thus the plug of smaller diameter than the prescribed size can be resiliently supported.

Since the invention according to the twelfth aspect is an invention according to the eleventh aspect, wherein the socket is provided with a mark on the flange for registering the resilient supporting portion of the plug and the plug holding portion, the mark serves as a registration when the resilient supporting portion of the plug is engaged with the plug holding portion of the socket, and thus the resilient supporting portion of the plug can easily be engaged with the plug holding portion of the socket.

What is claimed is:

1. A socket for automotive vehicles for receiving a plug of an appliance for automotive vehicles to electrically connect to a power supply, comprising:

a near cylindrical resinous molded body having an opening through which the plug is inserted and a flange formed along an outer periphery of said opening, and terminals formed on and embedded in a bottom surface of said molded body by insert molding;

wherein the socket is provided with a conductive inner case to be brought into contact with resilient electrodes of the plug on an inner wall surface of the socket, one of said terminals being in conduction with said inner case, and a bimetal positioned within the cylindrical body of the socket to be brought into contact with the terminal in conduction with the inner case in an event of abnormal heat generation, said bimetal being electrically connected to another one of the terminals disposed on the bottom surface of the socket and forming a short-circuit mechanism.

2. The socket for automotive vehicles as set forth in claim 1, wherein the inner case comprises a cylindrical portion formed on the inner wall surface of the socket, the terminal in conduction with the inner case which is projected from the cylindrical portion, and an earth terminal all formed of a piece of conductive metal plate.

3. The socket for automotive vehicles as set forth in claim 2, wherein the terminal in conduction with the inner case and the earth terminal are formed by tucking down from the inner wall surface of the socket to form recesses for disposing a resin material forming the socket.

4. The socket for automotive vehicles as set forth in claim 1, 2 or 3, wherein socket is formed in the opening with a plug holding portion to which resilient supporting portions provided on the outer periphery of the plug engage.

5. The socket for automotive vehicles as set forth in claim 4, wherein the socket is provided with a mark on the flange for registering the resilient supporting portions of the plug and the plug holding portion.

6. The locket for automotive vehicles as set forth in claim 1, 2, or 3, wherein the terminal disposed on the bottom surface of the socket comprises a power supply connecting portion projecting outwardly from the bottom surface of the socket for being connected with the power supply, and a connecting projection being in contact with the electrode portion of the plug and exposed from the center of the bottom surface, and the bimetal is electrically connected to the terminal disposed on the bottom surface of the socket at the portion surrounding the connecting projection.

7. The socket for automotive vehicles as set forth in claim 6, wherein the socket includes a projection formed of an insulating resin on the bottom surface.

8. The socket for automotive vehicles as set forth in claim 6, wherein the bimetal is formed into a near L-shape and formed with a through hole for fitting a shoulder formed around the connecting projection therein on one end and provided with a temperature deformation portion inserted into a hollow portion formed on the bottom surface of the socket so as to be opposed to the terminal in conduction with the inner case on the other side.

9. The socket for automotive vehicles as set forth in claim 8, wherein the socket includes a projection formed of an insulating resin on the bottom surface.

10. The socket for automotive vehicles as set forth in claim 6, wherein the terminal disposed on the bottom surface of the socket includes supporting strips disposed within said socket for positioning said terminal which project outwardly from the portion surrounding the connecting projection to be supported by a metal mold when the socket is molded by the metal mold.

11. The socket or automotive vehicles as set forth in claim 10, wherein the socket includes a projection formed of an insulating resin on the bottom surface.

12. The socket for automotive vehicles as set forth in claim 10, wherein the bottom surface of the socket is formed of at least one insertion hole adjacent to the supporting strip or the connecting projection, the at least one insertion hole communicates with the opening in which the plug is inserted.

13. The socket for automotive vehicles as set forth in claim 12, wherein the socket includes a projection formed of an insulating resin on the bottom surface.

14. A socket for automotive vehicles for receiving a plug of an appliance for automotive vehicles to electrically connect to a power supply, comprising:

a near cylindrical resinous molded body having an opening through which the plug is inserted and a flange formed along an outer periphery of said opening, and terminals formed on and embedded in a bottom surface of said molded body by insert molding;

wherein the socket includes a projection formed of an insulating resin on the bottom surface.

15. A socket for automotive vehicles for receiving a plug of an appliance for automotive vehicles to electrically connect to a power supply, comprising:

a near cylindrical resinous molded body having an opening through which the plug is inserted and a flange formed along an outer periphery of said opening, and terminals formed on and embedded in a bottom surface of said molded body by insert molding;

wherein the socket is formed with resilient arresting strips on the outer periphery thereof to which the inner edge of a mounting hole on a vehicle-side member abuts, and a threaded portion with which a nut for screwing the socket to the mounting hole on the vehicle-side member engages.

16. The socket for automotive vehicles as set forth in claim 15, wherein the socket is formed in the opening with a plug holding portion to which resilient supporting portions provided on the outer periphery of the plug engage.

17. A socket for automotive vehicles for receiving a plug of an electrical appliance, comprising:

a resinous molded body having a substantially cylindrical shape with first and second ends, said first end being open for receiving a plug of an electrical appliance, and said second end comprising a substantially closed bottom surface;

first and second terminals extending through and embedded in the bottom surface of said molded body by insert molding, said first terminal having a first end for connection to a power supply outside of the molded body and a second end having a connecting projection exposed on the bottom surface within the molded body;

a bimetal connected to the connecting projection of said first terminal and having a temperature deformation portion disposed within a hollow portion formed on the bottom surface of said molded body; and said second terminal comprising a single piece of conductive metal plate having a cylindrical inner case disposed on an inner wall of the molded body, a first portion projected from the inner case through the bottom surface of the molded body for connection to a ground terminal outside of the molded body, and a second portion projected from the inner case to a position within the hollow portion of the molded body for contact by the temperature deformation portion of the bimetal in case of abnormal heat generation.

* * * * *

UNITED STATES PATENT AND TRADEMARK OFFICE

CERTIFICATE OF CORRECTION

PATENT NO. : 6,619,983 B2 
DATED : September 16, 2003
INVENTOR(S) : Hidetoshi Ota et al.

It is certified that error appears in the above-identified patent and that said Letters Patent is hereby corrected as shown below:

Column 10,
Line 24, replace “wherein socket” with -- wherein the socket --.
Line 30, replace “locket” with -- socket --.

Signed and Sealed this

Twenty-fifth Day of November, 2003

JAMES E. ROGAN
*Director of the United States Patent and Trademark Office*